United States Patent [19]

Hagler et al.

[11] 4,384,098

[45] May 17, 1983

[54] FILAMENTARY POLYPROPYLENE AND METHOD OF MAKING

[75] Inventors: Gerald E. Hagler; Charles S. Hatcher, both of Greenville, S.C.

[73] Assignee: Phillips Petroleum Company, Bartlesville, Okla.

[21] Appl. No.: 224,771

[22] Filed: Jan. 13, 1981

[51] Int. Cl.[3] ..... D04H 1/04

[52] U.S. Cl. ..... 526/348.1; 264/176 F; 264/210.8; 526/351

[58] Field of Search ..... 264/176 F, 210.8; 526/348.1, 351

[56] References Cited

U.S. PATENT DOCUMENTS

| | | | |
|---|---|---|---|
| 2,947,598 | 8/1960 | Maragliano et al. | 264/176 F |
| 3,215,486 | 11/1965 | Hada et al. | 264/210.8 |
| 3,233,023 | 2/1966 | Benson | 264/168 |
| 3,361,859 | 1/1968 | Cenzato | 264/176 F |
| 3,432,590 | 3/1969 | Papps | 264/168 |
| 3,457,338 | 7/1969 | Leferre | 264/103 |
| 3,485,906 | 12/1969 | Oppenlander | 264/178 |
| 3,491,405 | 1/1970 | Palmer et al. | 264/176 F |
| 3,577,498 | 5/1971 | Matsuo et al. | 264/168 |
| 3,663,675 | 5/1972 | Zukuma et al. | 264/168 |
| 3,752,457 | 8/1973 | Parmaggiani et al. | 264/176 F |
| 3,925,525 | 12/1975 | Lahiere | 264/204 |
| 3,979,496 | 9/1976 | Schwauz | 264/168 |
| 4,193,461 | 3/1980 | Roberts | 264/176 F |
| 4,282,076 | 8/1981 | Boynton | 264/176 F |
| 4,303,606 | 12/1981 | Roberts | 264/176 F |

FOREIGN PATENT DOCUMENTS

| | | | |
|---|---|---|---|
| 45-2333 | 1/1970 | Japan | 264/210.8 |

*Primary Examiner*—Jay H. Woo

[57] ABSTRACT

In accordance with the present invention, novel lustrous, filamentary polypropylene products are produced by melt spinning a polypropylene resin, having a molecular weight distribution of less than about 7 and a melt flow between about 20 and about 60, at a spinning temperature below about 510° F. and taking up the spun filaments at a speed above about 1200 meters per minute. A novel product having a high degree of luster is also produced in accordance with the present invention.

14 Claims, No Drawings

FILAMENTARY POLYPROPYLENE AND METHOD OF MAKING

BACKGROUND OF THE INVENTION

The present invention relates to a process for making filamentary polypropylene products by melt spinning and the products thereof.

While fibrous or filamentary polyolefins, particularly polypropylene, have been found to possess certain characteristics superior to other synthetic fibrous materials, it is also generally recognized that fibrous polyolefins have peculiarities not possessed by other synthetic fibrous materials. For example, certain polypropylene resins when melt spun under certain specific conditions result in the production of filamentary products having a dull appearance. While such a dull appearance is acceptable and, in many cases, highly desirable for certain end uses, there are other uses for which a lustrous filamentary material or a lustrous yarn is desired.

It is therefore an object of the present invention to provide a process and product which overcome the above-mentioned deficiencies of the prior art. Another object of the present invention is to provide an improved process for producing lustrous, filamentary polypropylene materials. Another and further object of the present invention is to provide an improved lustrous, filamentary polypropylene product. These and other objects of the present invention will be apparent from the following description.

SUMMARY OF THE INVENTION

In accordance with the present invention, novel lustrous, filamentary polypropylene products are produced by melt spinning a polypropylene resin, having a molecular weight distribution of less than about 7 and a melt flow between about 20 and about 60, at a spinning temperature below about 510° F. and taking up the spun filaments at a speed above about 1200 meters per minute. A novel product having a high degree of luster is also produced in accordance with the present invention.

When conventional polypropylene resins are melt spun at most frequently utilized melt spinning conditions the filamentary materials produced have been found to have a dull or nonlustrous appearance. On the other hand it has unexpectedly been found in accordance with the present invention that when a specific type of polypropylene resin is melt spun under specific conditions, filamentary products having a high luster can be produced.

For purposes of characterizing and distinguishing various polypropylene resins, reference is made herein to the "molecular weight distribution" of the resin and the "melt flow" of the resin. Accordingly, the term "molecular weight distribution", as utilized herein, refers to the ratio of the weight average molecular weight to the number average molecular weight of the resin. The term "melt flow", as utilized herein, refers to the weight in grams of the polymer which can be extruded within a particular time under a constant dead weight load at a given temperature as determined by ASTM-D-1238, Condition "L". Conventionally utilized polypropylene resins which may be characterized as having a "broad" molecular weight distribution will have a molecular weight distribution above about 7 and typically about 12.1 and a melt flow of less than about 20, typically between about 10 and 12. By contrast, the specific polypropylene resins found useful in accordance with the present invention are said to have a "narrow" molecular weight distribution less than about 7 and typically between about 4.2 and 7.5 and a melt flow between about 20 and about 60, typically between about 21 and 57.

It is conventional in melt spinning to utilize spinnerets whose openings have a particular cross-sectional configuration. For example, often produced cross-sectional configurations are the so-called "delta" and the so-called "Y" cross section. When referring to these particular cross-sectional configurations it is often helpful in defining the product to measure the "modification ratio" of the filaments. Accordingly, the term "modification ratio" as utilized herein is the ratio of the diameter of the smallest circle which can be circumscribed about the outside of the filament over the diameter of the largest circle which can be subscribed on the inside of the filament.

The most usual or typical spinning conditions utilized in the art include spinning temperatures above about 500° F. and typically above about 510° F. and takeup speeds, or the speeds at which the filaments are wound up after spinning, include speeds below about 1200 meters per minute (MPM) and typically between 800 and 1000 MPM.

The preferred polyolefin, fiber-forming materials for use in accordance with the present invention are homopolymers of polypropylene. However, a fiber-forming resin comprising a copolymer of propylene with a small amount (less than 15%) of an olefinic monomer, such as ethylene, butene or a diene monomer, such as butadiene, isoprene, etc, may be employed. If desired, a fiber-forming resin blend composed of a predominant amount of a propylene polymer and a small amount (less than 15%) of at least one polymer of the above mentioned olefinic or diene compound may be used. Therefore the term'-'polypropylene" as used herein is intended to include the propylene homopolymers, polymer blends and copolymers mentioned above. As for the fiber forming resin, it is preferable to employ a crystalline polypropylene homopolymer having a molecular weight distribution of less than about 7 and a melt flow of between about 20 and about 60.

Prior work by applicants and their associates have shown that filamentary materials made from the narrow molecular weight distribution polypropylene resins have a number of distinct advantages and properties not possessed by the conventional or broad molecular weight distribution polypropylene resins. Consequently, it is desirable in many cases to utilize the specific narrow molecular weight distribution material. However, it was found that, while the broad molecular weight distribution conventional resins when spun at conventional conditions, for example 510° F. and 1000 MPM, produced filaments and accordingly yarns having a relatively high degree of luster, by contrast, the narrow molecular weight distribution materials when processed at the same conventional conditions were found to be quite dull in appearance and therefore unsuitable for certain uses, such as in macrame yarns. However, it was found unexpectedly that if the narrow molecular weight distribution polypropylene resin was melt spun at temperatures below about 510° F., preferably between about 420° and 480° F. and ideally at about 460° F., and at takeup speeds above about 1000 MPM, or specifically between about 1200 and 3000 MPM and ideally at about 2000 MPM filamentary materials, yarns having a high degree of luster could be produced. It was also observed that as the spinning temperature decreased below the maximum specified the degree of luster increased and as the spinning speed increased above the minimum specified, the luster increased. Finally, it was found that the luster of the filamentary materials, and thus the yarns, could be further increased by drawing the filaments or yarn.

At the time that it was discovered that the processing of the narrow molecular weight distribution polypropylene resin at the relatively low temperatures and relatively high takeup speeds produced lustrous filaments and yarns, a series of experiments were carried out to determine the reasons for the differences in luster exhibited by the narrow molecular weight distribution polypropylene resins thus processed as opposed to the processing of the same resin under conventional conditions. It was at first thought that differences in cross section, delta as opposed to "Y" cross sections and/or differences in the modification ratio of these filaments were responsible for the differences in luster. Accordingly, samples were produced having the following configurations, at specified spinning temperatures, to produce yarns having the specified deniers and modification ratios.

TABLE

| Cross Section | Spin Temp. °F. | Denier | Modification Ratio |
|---|---|---|---|
| Y | 460 | 1201 | 2.40 |
| Y | 510 | 1210 | 2.18 |
| Y | 460 | 868 | 2.16 |
| Y | 510 | 861 | 1.84 |
| Δ | 460 | 1200 | 1.40 |
| Δ | 510 | 1208 | 1.25 |
| Δ | 460 | 868 | 1.28 |
| Δ | 510 | 866 | 1.26 |

Microscopic examination and inspection of photomicrographs of the filamentary materials showed that there was a definite difference between the luster of the filaments produced at 460° F. and those produced at 510° F. However, there was no observable difference between the filamentary materials having "Y" cross sections as opposed to a delta cross section, nor between the materials of different deniers. Also, there was no observable differences in luster as the modification ratio of the filamentary materials changed.

On the other hand, it was observed and it is believed that the differences in luster among the samples was due to a difference in the size and/or content of spherulites in the filaments. For example, the filaments spun at low temperatures and high speeds had a high luster and were relatively free of large spherulites. On the other hand, filamentary materials having a dull appearance or luster appeared to have large and/or a large number of spherulites present.

It was also found that by drawing the filamentary materials produced from the narrow molecular weight distribution polypropylene resins at the relatively low temperatures and relatively high takeup speeds at draw ratios between about 2X and 4X, the luster of the drawn filamentary materials was also superior to that of the undrawn filamentary materials. The following table shows the nature of filamentary materials utilized in these comparisons when they were drawn to 300 denier.

TABLE II

| Cross Section | Spin Temp. °F. | Modification Ratio |
|---|---|---|
| Y | 460 | 2.49 |
| Y | 510 | 1.97 |
| Δ | 460 | 1.34 |
| Δ | 510 | 1.28 |

Specifically, it was found that the spherulite content in all drawn samples was lower than that in the undrawn samples and yarns drawn at 4X draw ratio had smaller spherulites than yarns drawn at 2.74X draw ratio.

While specific materials, specific conditions and specific modes of operation have been set forth in the examples hereof it is to be understood that such specific examples are for illustrative purposes only and are not to be considered limiting.

We claim:

1. A process for making filamentary materials having a high degree of lustre, comprising:

melt spinning a polypropylene resin, having a molecular weight distribution of less than about 7 and a melt flow between about 20 and about 60, at a spinning temperature below about 510° F. and at a takeup speed above about 1000 meters per minute.

2. A process in accordance with claim 1 wherein the spinning temperature is between about 420° and about 480° F.

3. A process in accordance with claim 2 wherein the spinning temperature is about 460° F.

4. A process in accordance with claim 1 wherein the filamentary material takeup speed is between about 1200 and about 5000 meters per minute.

5. A process in accordance with claim 4 wherein the filamentary material takeup speed is about 2000 meters per minute.

6. A process in accordance with claim 1 wherein the filamentary materials are also drawn.

7. A process in accordance with claim 6 wherein the filamentary materials are drawn at a draw ratio between about 2 to 1 and about 4 to 1.

8. Polypropylene filamentary materials having a high degree of luster, comprising:

filamentary materials melt spun from a polypropylene resin having a molecular weight distribution of less than about 7 and a melt flow between about 20 and about 60, at a spinning temperature below about 510° F. and at a spinning takeup speed above about 1000 meters per minute.

9. Filamentary materials in accordance with claim 8 wherein the spinning temperature is between about 420° and about 480° F.

10. Filamentary materials in accordance with claim 9 wherein the spinning temperature is about 460° F.

11. Filamentary materials in accordance with claim 1 wherein the filamentary material takeup speed is between about 1200 and about 5000 meters per minute.

12. Filamentary materials in accordance with claim 11 wherein the filamentary material takeup speed is about 2000 meters per minute.

13. Filamentary materials in accordance with claim 8 wherein filamentary materials are drawn filamentary materials.

14. Filamentary materials in accordance with claim 13 wherein the filamentary materials have been drawn at a draw ratio between about 2 to 1 and 4 to 1.

* * * * *